US007288157B2

(12) United States Patent
Kajinic et al.

(10) Patent No.: US 7,288,157 B2
(45) Date of Patent: Oct. 30, 2007

(54) CORROSION AND WEAR RESISTANT ALLOY

(75) Inventors: Alojz Kajinic, Carnegie, PA (US); Andrzej L. Wojcieszynski, Pittsburgh, PA (US); Maria K. Sawford, Coraopolis, PA (US)

(73) Assignee: Crucible Materials Corp., Syracuse, NY (US)

( * ) Notice: Subject to any disclaimer, the term of this patent is extended or adjusted under 35 U.S.C. 154(b) by 0 days.

(21) Appl. No.: 11/598,082

(22) Filed: Nov. 13, 2006

(65) Prior Publication Data

US 2007/0056657 A1 Mar. 15, 2007

Related U.S. Application Data

(63) Continuation-in-part of application No. 11/124,350, filed on May 9, 2005, now abandoned.

(51) Int. Cl.
*C22C 38/00* (2006.01)
*C22C 5/10* (2006.01)

(52) U.S. Cl. ..... 148/325; 420/12

(58) Field of Classification Search ..... 148/325; 420/12

See application file for complete search history.

(56) References Cited

FOREIGN PATENT DOCUMENTS

| | | | |
|---|---|---|---|
| CN | 1264749 | * | 8/2000 |
| JP | 06145901 | * | 5/1994 |

* cited by examiner

*Primary Examiner*—Sikyin Ip
(74) *Attorney, Agent, or Firm*—Finnegan, Henderson, Farabow, Garrett & Dunner LLP

(57) ABSTRACT

A powder metallurgy corrosion and wear resistant tool steel article, and alloy thereof. The article is manufactured by hot isostatic compaction of nitrogen atomized, prealloyed high-chromium, high-vanadium, high-niobium powder particles. The alloy is characterized by very high wear and corrosion resistance, making it particularly useful for use in the manufacture of components for advanced bearing designs as well as machinery parts exposed to severe abrasive wear and corrosion conditions, as encountered, for example, in the plastic injection molding industry and food industry.

7 Claims, 4 Drawing Sheets

JPE

CH#6

04-099

An example of the microstructure of the alloys of invention – the optical microstructure of alloy WR-11 etched in Beraha's etchant: nickel based matrix (dark phase) with alloy carbides (white particles): a) magnification 200x, b) magnification 100x.

An example of the microstructure of the alloys of invention – the optical microstructure of alloy WR-11 etched in Beraha's etchant: nickel based matrix (dark phase) with alloy carbides (white particles): a) magnification 200x, b) magnification 100x.

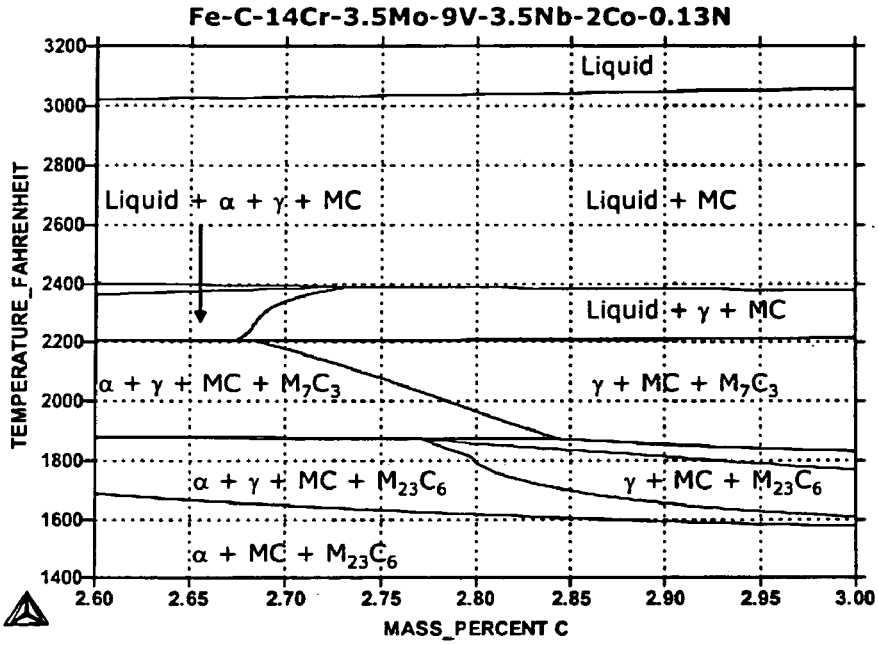
Figure 2: A vertical section of the Fe-C-Cr-Mo-V-Nb-Co-N system at 14 wt % Cr, 3.5 wt % Mo, 9 wt % V, 3.5 wt % Nb, 2 wt Co, and 0.13 wt % N.

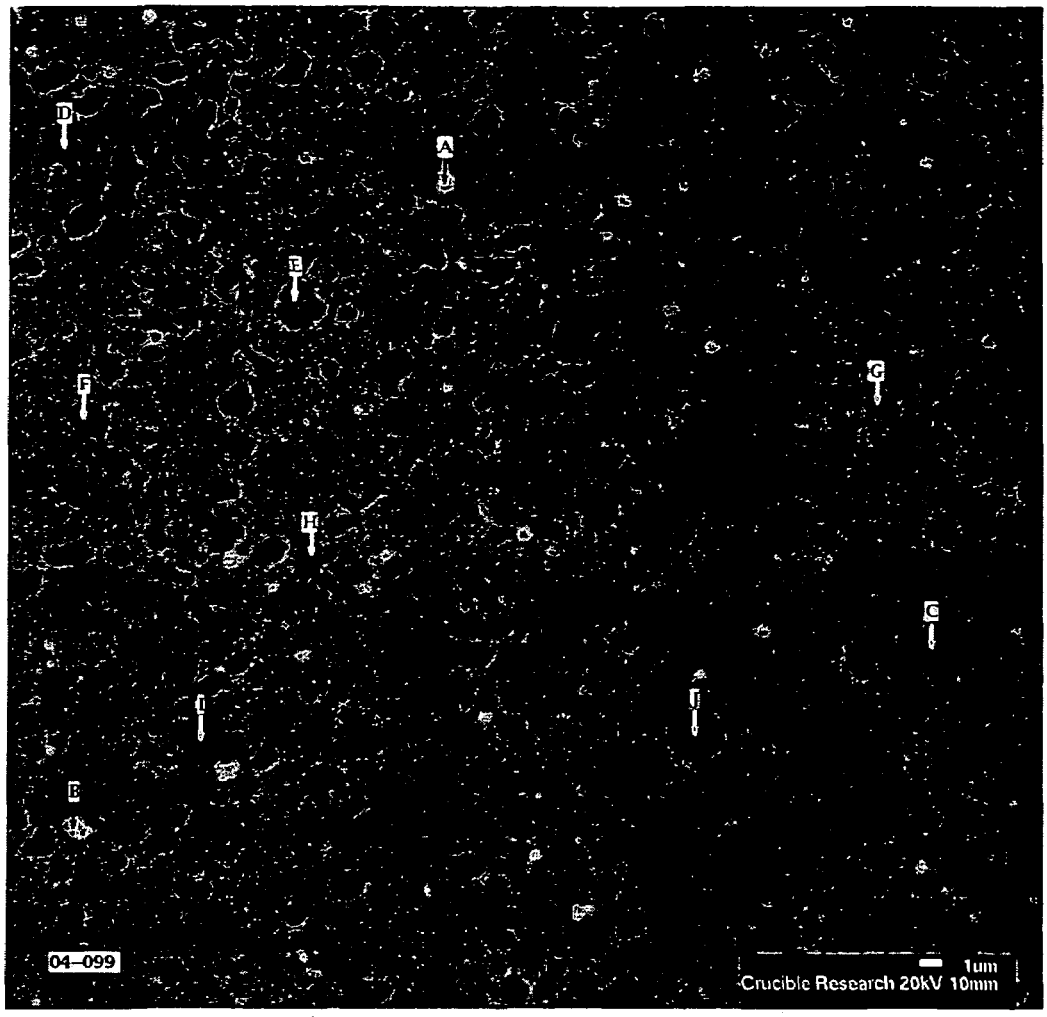
Figure 3: Backscatter SEM image (magnification of 1500X) of the alloy of the invention (04-099) hardened from 2150°F in oil and tempered at 975°F for 2h+2h+2h. The white particles (particles A and B) are the niobium-rich carbides. Particles E-J are the vanadium-niobium-rich carbides.

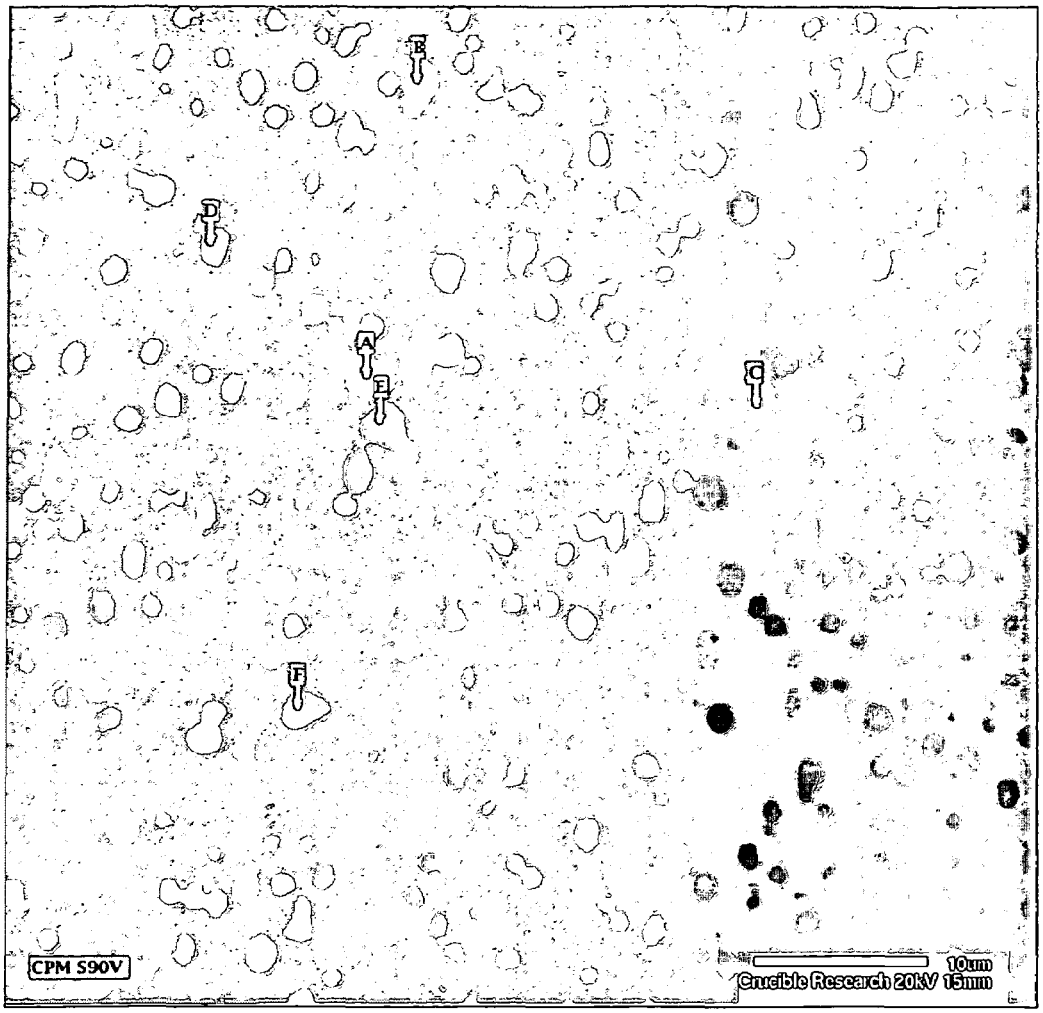
Figure 4: Backscatter SEM image (magnification of 1500X) of CPM S90V (the benchmark alloy) hardened from 2150°F in oil and tempered at 975°F for 2h+2h+2h. Particles A-C are the chromium-rich carbides. Particles D-F are the vanadium-rich carbides.

CORROSION AND WEAR RESISTANT ALLOY

This is a Continuation-In-Part application of U.S. patent application Ser. No. 11/124,350 filed May 9, 2005 now abandoned.

FIELD OF THE INVENTION

The invention relates to a new powder metallurgy corrosion and wear resistant tool steel, with improved corrosion resistance in comparison to that of other corrosion and wear resistant tool steels. The invention relies on a discovery that adding niobium to a corrosion and wear resistant tool steel results in the formation of niobium-rich primary carbides which do not dissolve large amounts of chromium. As a result of the formation of the niobium-rich carbides, less carbon is available in the matrix to form chromium-rich carbides. Therefore, more chromium remains dissolved in the matrix and contributes to better corrosion resistance. An additional improvement in corrosion resistance was realized by optimizing the molybdenum content.

The alloy is produced by hot isostatic pressing of nitrogen atomized, prealloyed powder particles. By hot isostatic pressing of nitrogen gas atomized prealloyed powder particles a homogeneous microstructure and composition is achieved, which is critical to the processing characteristics of the alloy and allows for uniform properties in larger cross-sections. The microstructure and properties make the alloy of the invention particularly useful as a material from which to make components of machinery which are exposed to severe abrasive wear and corrosive conditions such as those, among many others, in the plastic injection molding industry, the food industry, and for advanced bearing applications.

BACKGROUND OF THE INVENTION

To perform satisfactorily, the alloys that are used in a number of demanding applications such as screws and barrels in the plastic injection molding industry, must be resistant to wear and corrosive attack. The trend in the industry is to keep increasing processing parameters (e.g., temperature and pressure), which in turn impose ever-increasing demands on the alloys and their ability to successfully withstand corrosive attack and wear by the materials being processed. In addition, the corrosiveness and abrasiveness of those materials are constantly increasing.

In order to withstand the stresses imposed during operation, the tool steel must also possess sufficient mechanical properties, such as hardness, bend fracture strength, and toughness. In addition, the tool steel must possess sufficient hot workability, machinability and grindability to ensure that parts with the required shape and dimensions can be manufactured.

The corrosion resistance of wear resistant tool steels depends primarily on the amount of "free" chromium in the matrix, i.e., the amount of chromium that is not "tied up" into carbides. Due to the formation of chromium-rich carbides, the amount of "free" chromium in the matrix is not necessarily the same amount as that in the overall chemical composition. For good corrosion resistance, through-hardening tool steels must contain at least 12 wt. % of "free" chromium in the martensitic matrix after heat treatment.

The wear resistance of tool steels depends on the amount, type, and size distribution of the primary carbides, as well as the overall hardness. The main function of the primary alloy carbides, due to their high hardness, is to provide wear resistance. Of all types of primary carbides commonly found in tool steels, vanadium-rich MC primary carbides possess the highest hardness. In general, the higher the volume fraction of primary carbides, the higher the wear resistance of the tool steel, and the lower its toughness and hot workability.

Corrosion and wear resistant martensitic tool steels must also contain a relatively high level of carbon for the formation of primary carbides and heat treatment response. As chromium has a high affinity for carbon with which it forms chromium-rich carbides, corrosion and wear resistant tool steels must contain excess chromium over the amount necessary for corrosion resistance to allow for carbide formation.

The corrosion and wear resistant martensitic tool steels that are commercially available include grades such as 440C, CPM S90V, M390, Elmax and HTM X235, among others. Despite the fact that the overall chromium content of some of these alloys is as high as 20 wt. % (e.g., M390), the corrosion resistance is not necessarily as good as one might expect. Depending on the overall chemical composition and the heat treatment parameters, a large amount of chromium is pulled out of the matrix and tied up into chromium-rich carbides. This tied up chromium does not contribute toward corrosion resistance.

One of the practices that has been used to improve the combination of wear and corrosion resistance, as exemplified by U.S. Pat. No. 2,716,077, is to add vanadium. This alloying addition forms hard vanadium-rich MC primary carbides and ties up a part of the carbon. Due to the fact that the affinity of vanadium toward carbon is higher than that of chromium, the presence of vanadium in tool steels decreases the amount of chromium-rich primary carbides, all other conditions being equal (i.e., the overall chromium and carbon content and the heat treatment parameters).

The corrosion resistance of tool steels is further improved by the presence of molybdenum in the martensitic matrix. An example is Crucible 154 CM grade, which is based on the Fe-1.05C-14Cr-4Mo system.

A primary objective of the invention is to provide a wear and corrosion resistant powder metallurgy tool steel with significantly improved corrosion and wear resistance. In the alloy of the invention, in addition to vanadium, niobium is used to further increase the amount of MC primary carbides. This in turn decreases the amount of chromium-rich primary carbides due to the fact that niobium has an even higher affinity toward carbon than vanadium.

To obtain the desired combination of wear and corrosion resistance in the alloy of the invention it is necessary to have chromium in combination with niobium, molybdenum, and vanadium within the claimed ranges. Specifically, the presence of niobium within the claimed range lowers the amount of chromium that dissolves in the MC primary carbides and thus increases the amount of "free" chromium in the matrix. Niobium retards the formation of chromium-rich carbides, enabling a greater part of the chromium to remain in the matrix to achieve the desired corrosion resistance of the alloy. Thus, balancing the chromium, niobium, and vanadium contents within the claimed limits allows the excess chromium (over that combining with the carbon to form carbides) to remain in the matrix to provide the desired corrosion resistance. Vanadium and niobium are added to achieve directly wear resistance, and to indirectly improve corrosion resistance.

SUMMARY OF THE INVENTION

It has been discovered that an improved balance between wear resistance, corrosion resistance, and hardness of the high-chromium, high-vanadium, powder metallurgy martensitic stainless steel alloy of the invention can be achieved by adding niobium. The alloy of the invention possesses a unique combination of corrosion and wear properties that are achieved by balancing its overall chemical composition as well as selecting an appropriate heat treatment.

It has been discovered that the addition of niobium decreases the solubility of chromium in (vanadium-niobium-rich) MC primary carbides, which in turn increases the amount of "free" chromium in the martensitic matrix. In addition, thermodynamic calculations have shown that the carbon sublattice of the vanadium-niobium-rich MC primary carbides that precipitate in the alloy of the invention has less vacancies (i.e., is richer in carbon) compared to the carbon sublattice of the comparable vanadium-rich MC primary carbides: $(V, Nb)C_{0.83}$ versus $VC_{0.79}$, respectively. Therefore, with the alloy of the invention more carbon is needed for the precipitation of the vanadium-niobium-rich carbides and, in turn, less carbon is available for the precipitation of chromium-rich carbides.

In order to obtain the desired combination of wear and corrosion resistance, along with good mechanical properties such as bend fracture strength, toughness, and grindability, the alloy of the invention is produced by nitrogen atomization to obtain prealloyed powder particles. The prealloyed powder particles can be hot isostatically pressed in a container for further processing to bar form or the powders can be HIP/clad to form a near-net-shape part.

In accordance with the invention, there is provided a corrosion and wear resistant alloy produced by hot isostatic pressing of nitrogen gas atomized prealloyed powder particles within the following composition limits, in weight percent: carbon, 2.0 to 3.5, preferably 2.3 to 3.2, more preferably 2.7 to 3.0; silicon 1.0 max., preferably 0.9 max., more preferably 0.70 max; manganese 1.0 max., preferably 0.8 max, more preferably 0.50 max; chromium 12.5 to 18.0, preferably 13.0 to 16.5, more preferably 13.5 to 14.5; molybdenum 2.0 to 5.0, preferably 2.5 to 4.5, more preferably 3.0 to 4.0; vanadium 6.0 to 11.0, preferably 7.0 to 10.5, more preferably 8.5 to 9.5; niobium 2.6 to 6.0, preferably 2.8 to 5.0, more preferably 3.0 to 4.0; cobalt 1.5 to 5.0, preferably 1.5 to 4.0, more preferably 2.0 to 3.0; nitrogen 0.11 to 0.30, preferably 0.11 to 0.25, more preferably 0.11 to 0.20; and balance iron and incidental impurities.

To obtain the desired corrosion resistance it is necessary that carbon is balanced with chromium, niobium, molybdenum, vanadium, and nitrogen in accordance with the following equations:

$$C_{min}=0.4+0.099\times(\%\ Cr-11)+0.063\times\%\ Mo+0.177\times\%\ V+0.13\times\%\ Nb-0.85\times\%\ N \quad \text{(Eq. 1)}$$

$$C_{max}=0.6+0.099\times(\%\ Cr-11)+0.063\times\%\ Mo+0.177\times\%\ V+0.13\times\%\ Nb-0.85\times\%\ N \quad \text{(Eq. 2)}$$

where:

$C_{min}$, $C_{max}$—minimum and maximum carbon content, respectively, of the alloy, in weight %;

% Cr, % Mo, % V, % Nb, % N—alloy content of chromium, molybdenum, vanadium, niobium, and nitrogen, respectively, in weight %.

The alloy exhibits a corrosion pitting potential measured in a 1% NaCl aqueous solution of at least 250 mV after tempering at a lower tempering temperature of 500° F. to 750° F., and greater than −100 mV after tempering at a higher tempering temperature of 975° F. to 1025° F.

BRIEF DESCRIPTION OF THE DRAWINGS

FIG. 2 is a vertical section of the Fe—C—Cr—Mo—V—Nb—Co—N system at 14 wt % Cr, 3.5 wt % Mo, 9 wt % V, 3.5 wt % Nb, 2 wt Co, and 0.13 wt % N.

FIG. 3 shows the backscatter SEM image (magnification of 1500×) of the alloy of the invention (04-099) hardened from 2150° F. in oil and tempered at 975° F. for 2 h+2 h+2 h;

FIG. 4 shows the backscatter SEM image (magnification of 1500×) of Alloy A (the benchmark alloy) hardened from 2150° F. in oil and tempered at 975° F. for 2 h+2 h+2 h.

DESCRIPTION OF THE EMBODIMENTS

Chemical Compositions Tested

Figure 1:
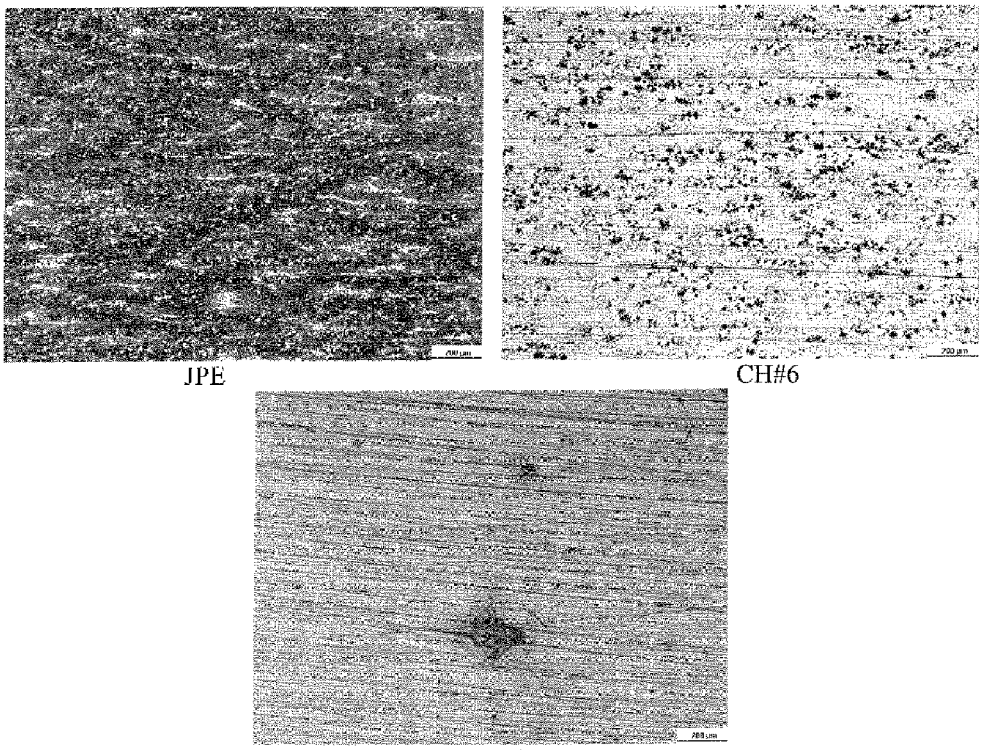
FIG. 1 shows the etched microstructure (magnification of 500×) of the alloy of the invention (04-099) hardened from 2150° F. in oil and tempered at 975° F. for 2 h+2 h+2 h.

Table 1 gives the chemical compositions of the alloys that were experimentally examined. In the preparation of all examined compositions, prealloyed tool steel grades of the various reported chemical compositions were melted in a nitrogen atmosphere, atomized by nitrogen gas, and hot isostatically pressed (HIP) at a temperature of about 2150° F. (±50° F.). The HIPed compacts were forged to 2.5"×⅞" bar to prepare specimens for corrosion and mechanical testing.

With respect to the various alloying elements in the wear and corrosion resistant tool steel, the following applies.

Carbon is present in an amount of at least 2.0%, while the maximum content of carbon may amount to 3.5%, and preferably in the range of 2.3-3.2% or more preferably 2.7-3.0%. It is important to carefully control the amount of carbon in order to obtain a desired combination of corrosion and wear resistance, as well as to avoid forming either ferrite or unduly large amounts of retained austenite during heat treatment. The carbon in the alloy of the invention must be balanced with the chromium, niobium, molybdenum, vanadium, and nitrogen contents of the alloy of the invention according to Equations 1 and 2.

Nitrogen is present in an amount of 0.11-0.30%, and preferably in the range of 0.11-0.25% or more preferably 0.11-0.20%. The effects of nitrogen in the alloy of the invention are rather similar to those of carbon. In tool steels, where carbon is always present, nitrogen forms carbonitrides with vanadium, niobium, tungsten, and molybdenum. Unlike carbon, nitrogen improves the corrosion resistance of the alloy of the invention when dissolved in the martensitic matrix.

Silicon may be present in an amount of 1% max., and preferably 0.9% max or more preferably 0.7% max. Silicon functions to deoxidize the prealloyed materials during the melting phase of the gas-atomization process. In addition, silicon improves the tempering response. Excessive amounts of silicon are undesirable, however, as it decreases toughness and promotes the formation of ferrite in the microstructure.

Manganese may be present in an amount of 1% max., and preferably 0.8% max or more preferably 0.5% max. Manganese functions to control the negative effects of sulfur on hot workability. This is achieved through the precipitation of manganese sulfides. In addition, manganese improves hardenability and increases the solubility of nitrogen in the liquid prealloyed materials during the melting phase of the gas-atomization process. Excessive amounts of manganese are undesirable, however, as it can lead to the formation of unduly large amounts of retained austenite during the heat treatment.

Chromium is present in an amount of 12.5-18.0%, and preferably in the range of 13.0 to 16.5% or more preferably 13.5-14.5%. The main purpose of chromium is to increase the corrosion resistance, and, to a lesser degree, to increase hardenability and secondary-hardening response.

Molybdenum is present in an amount of 2.0-5.0%, and preferably in the range of 2.5-4.5% or more preferably 3.0-4.0%. Like chromium, molybdenum increases the corrosion resistance, hardenability, and secondary-hardening response of the alloy of invention. Excessive amounts of molybdenum, however, reduce hot workability.

Vanadium is present in an amount of 6.0-11.0%, and preferably in the range of 7.0-10.5% or more preferably 8.5-9.5%. Vanadium is critically important for increasing wear resistance. This is achieved through the formation of vanadium-rich MC type primary carbides.

Niobium is present in an amount of 2.6-6.0%, and preferably in the range of 2.8-5.0% or more preferably 3.0-4.0%. Niobium and vanadium are equivalent elements when it comes to the formation of MC carbides. Every percent of niobium is equivalent to the amount of vanadium as calculated as follows:

$$\% V=(50.9/92.9)\times\% Nb \quad \text{(Eq. 3)}$$

where 50.9 and 92.9 are the atomic weights of vanadium and niobium, respectively. However, these two elements do not have the same effect on corrosion resistance. It was discovered that the presence of niobium decreases the solubility of chromium in the MC primary carbides, i.e., niobium-vanadium-rich MC primary carbides contain a smaller amount of chromium compared to vanadium-rich MC primary carbides. This in turn increases the amount of "free" chromium in the matrix, which in turn increases the corrosion resistance.

To illustrate the effect of niobium on the alloy of the invention, Thermo-Calc software, coupled with TCFE3 steel thermodynamic database, was used to model two alloys that have the equivalent amount of vanadium; one with niobium (Fe-2.8C-14Cr-3.5Mo-9V-3.5Nb-2Co-0.13N) and the other one without niobium (Fe-2.8C-14Cr-3.5Mo-11V-2Co-0.13N). The two alloys have the same vanadium equivalency (11% V). Thermodynamic calculations were performed for the following two austenitization temperatures: 2050° F. and 2150° F. The results are given in Tables 2 and 3. These calculations demonstrate that niobium indeed decreases the solubility of chromium in the MC primary carbides (see Table 3) which results in a larger amount of "free" chromium in the matrix.

Cobalt is present in an amount of 1.5-5.0%, and preferably in the range of 1.54.0% or 2.0-3.0% to ensure that the desired microstructure of the alloy of the invention is achieved upon heat treatment.

PROPERTIES OF THE ALLOY OF INVENTION

The microstructure, corrosion resistance and mechanical properties of the alloy of invention are compared to other commercially available wear and corrosion resistant alloys. The nominal chemical compositions of the commercial alloys are given in Table 4.

Microstructure

FIG. 1 shows the etched microstructure of an alloy of the invention (alloy number 04-099). The alloy was oil hardened from 2150° F. and tempered at 975° F. for 2 h+2 h+2 h. The primary carbides that are favored to form by the thermodynamics of the alloy of the invention are of MC and $M_7C_3$ type (FIG. 2). After etching with Vilella's reagent for 90 seconds, the total volume fraction of MC and $M_7C_3$ primary carbides was measured to be at least 21%. The ratio between vanadium-niobium-rich MC and chromium-rich $M_7C_3$ primary carbides is approximately 2-to-1.

The unique corrosion resistance of the alloy of invention in comparison to other wear and corrosion resistant PM alloys is an indirect effect of the presence of niobium-rich primary MC carbides, FIG. 3. The chemical composition of MC primary carbides of the alloy of the invention range from predominantly niobium-rich to predominantly vanadium-rich. For comparison, the MC carbides of Alloy A are vanadium-rich only (see FIG. 4).

The difference in chemical composition of the primary MC carbides in an alloy of the invention and Alloy A is demonstrated in Table 5. The primary carbides in Alloy A primarily contain vanadium and smaller amounts of chromium, molybdenum and iron. The chromium content in these carbides is about 8.2-9.2% (only metallic elements were taken into account). The niobium-rich MC carbides in the alloy of the invention contain a large amount of niobium and a smaller quantity of vanadium, iron and chromium. The chromium content in these carbides is only about 3.3-3.7%, which is significantly less than that in MC carbides in Alloy A. The chromium content in the niobium-vanadium-rich MC carbides in the alloy of the invention is also less than that in the MC carbides in Alloy A.

Corrosion Resistance

Pitting Resistance Equivalent Number: The pitting resistance equivalent number (PRE) is useful for evaluating the resistance of austenitic stainless steels to pitting and crevice corrosion. The PRE is calculated using the following equation:

$$PRE=Cr+3.3(Mo+0.5\ W)+13N \quad \text{(Eq. 4)}$$

Generally, the PRE is calculated using the bulk chemical composition of austenitic stainless steels. However, the alloy of invention and the commercially available wear and corrosion resistant alloys disclosed herein are martensitic steels that contain high amounts of primary carbides that deplete the matrix of some of the necessary elements needed for corrosion resistance. Therefore, the PRE of these alloys was calculated using an estimated matrix composition as determined by Thermo-Calc software (see Table 6).

Based on the matrix composition, the alloy of the invention (04-099) has the highest PRE even though it does not have the highest overall chromium content. The PRE of the alloy of the invention (04-099) is even higher than the PRE of those alloys with higher bulk chromium contents (e.g., Alloys C, D and E). This is because about 30% of the chromium in these high chromium alloys is used in the formation of the primary carbides. Only about 2% of the chromium in the invention alloy is used in the formation of the primary carbides therefore keeping most of the chromium in the matrix to aide in corrosion resistance. The high chromium content in the matrix in the alloy of the invention is due to the presence of niobium and vanadium, which preferentially form thermodynamically more stable MC-type carbides compared to the chromium-rich $M_7C_3$ type carbides.

Corrosion Tests: Potentiodynamic tests were used to evaluate the pitting resistance of the alloy of the invention and of commercially available wear and corrosion resistant alloys in a 1% NaCl solution. The tests were conducted according to ASTM G5. The pitting resistance of the alloys is defined by the pitting potential ($E_{pit}$) obtained from a potentiodynamic curve. The more positive the pitting potential, the more resistant the alloy is to pitting.

Tests were also conducted in a dilute aqua regia acid solution containing 2.5% $HNO_3$ and 0.5% HCl. The tests were conducted according to ASTM G59. The corrosion rates were calculated from the data collected during the test according to ASTM G102. In this case, the lower the corrosion rate, the more resistant the alloy is to general corrosion.

Depending on the application, the wear and corrosion resistant alloys are given different heat treatments. If corrosion resistance is of utmost concern, the alloy is typically tempered at or below 750° F., which allows more of the chromium to stay in the matrix by minimizing the precipitation of secondary carbides. If hardness and wear resistance is the primary concern, then the alloys are typically tempered at 950° F. and above to allow for secondary hardening effects to take place. Therefore, each alloy was tempered at 500° F., 750° F., 975° F., and 1025° F.

Results in 1% NaCl: The pitting potential ($E_{pit}$) for each alloy at each tempering temperature is given in Table 7. The results show that the alloy of the invention (04-099) which has the highest PRE also has the highest resistance to pitting at all tempering temperatures. The $E_{pit}$ for the alloy of the invention is almost 50% higher than that of the next closest alloy, Alloy C, at a tempering temperature of 500° F. In general, the alloys with 18-20% bulk chromium content, i.e., Alloys C, D and E, have mediocre pitting resistance compared to the alloy of the invention at all tempering temperatures. The alloy with the highest bulk chromium content actually has one of the lowest pitting potentials at the low tempering temperatures. These results indicate that the total chromium content in martensitic tool steels is not a good indicator of their corrosion resistance.

Results in dilute aqua regia: The corrosion rate for each alloy in a dilute aqua regia solution for a given tempering temperature is given in Table 8. Again, the results show that 04-099 has the lowest corrosion rate of all the alloys tested at all tempering temperatures. Even by tempering 04-099 at 1025° F. to achieve the best combination of mechanical properties, its corrosion rate is similar to or lower than the other alloys tempered at 750° F.

Alloy B is a martensitic stainless steel that is commonly used in applications which require wear and corrosion resistance. This steel contains, among other elements, 1% C and 17% Cr. It is important to note that it is necessary to have 17% Cr in this steel to offset the effect of 1% C and to achieve corrosion resistance. It was demonstrated in Table 6 that the matrix of this steel contains only 11.6% Cr, the remaining portion being tied up in the form of carbides. Table 6 demonstrates that the matrix of the alloy of the invention, 04-099, contains 13.7% Cr, which contributes to the superior corrosion resistance of this alloy, despite the total chromium content of about 14%.

Heat Treatment Response

When compared with Alloy A, the alloy of the invention (04-098 and 04-099) offers somewhat better heat treatment response—approximately 1.0-2.0 HRC higher for the same heat treatment. The heat treatment responses of the alloy of the invention and Alloy A are given in Table 9.

Abrasive Wear Resistance

The abrasion resistance was measured in a pin abrasion wear test according to ASTM G132. The results are reported as a pin abrasion weight loss and given in mg. The lower the pin abrasion weight loss the better the abrasion wear resistance.

The pin abrasion wear resistance test specimens were austenitized at 2150° F. for 10 minutes, oil quenched, and tempered at either 500° F. (for maximum corrosion resistance) or 975° F. (for maximum secondary-hardening response) for 2 h+2 h+2 h. The results are given in Table 10. The pin-abrasion wear resistance of Alloy A is included for comparison. The results show that the wear resistance of the alloy of the invention is better than the wear resistance of Alloy A.

By balancing the alloy content, particularly that of carbon and that of the strong carbide forming elements such as vanadium and niobium, the alloy of the invention achieved not only the best corrosion resistance among the known corrosion and wear resistant martensitic tool steels, but it also achieved an improved wear resistance.

TABLE 1

Chemical compositions that were experimentally examined and modeled with Thermo-Calc software [wt. %].

| Alloy | C | Cr | Mo | W | V | Nb | Co | N |
|---|---|---|---|---|---|---|---|---|
| 03-192 | 2.61 | 14.23 | 3.02 | — | 8.10 | 3.08 | 1.95 | 0.157 |
| 03-193 | 2.66 | 14.23 | 3.02 | — | 8.10 | 3.08 | 1.95 | 0.157 |
| 03-194 | 2.71 | 14.23 | 3.02 | — | 8.10 | 3.08 | 1.95 | 0.157 |
| 03-195 | 2.81 | 14.23 | 3.02 | — | 8.10 | 3.08 | 1.95 | 0.157 |
| 03-199 | 2.49 | 14.20 | 2.97 | — | 7.78 | 3.13 | 1.99 | 0.115 |
| 03-200 | 2.59 | 14.20 | 2.97 | — | 7.78 | 3.13 | 1.99 | 0.115 |
| 03-201 | 2.64 | 14.20 | 2.97 | — | 7.78 | 3.13 | 1.99 | 0.115 |
| 04-098 | 2.76 | 13.76 | 3.49 | — | 8.98 | 3.50 | 1.96 | 0.127 |
| 04-099 | 2.83 | 13.76 | 3.49 | — | 8.99 | 3.51 | 1.96 | 0.134 |
| 04-100 | 2.68 | 13.89 | 3.35 | — | 9.03 | 3.42 | — | 0.125 |

TABLE 2

Chemical composition of austenitic matrix at 2050° F. and 2150° F. calculated with Thermo-Calc coupled with TCFE3 database.

| | | Chemical Composition of Austenitic Matrix [wt. %] | | | | | | | |
|---|---|---|---|---|---|---|---|---|---|
| Alloy | [° F.] | C | Cr | Mo | V | Nb | Co | N | Fe |
| 9V-3.5Nb | 2050 | 0.4 | 13.4 | 2.5 | 1.2 | 0.008 | 2.5 | 0.004 | bal. |
| 11V-0Nb | | 0.4 | 12.6 | 2.3 | 1.4 | — | 2.5 | 0.002 | bal. |
| 9V-3.5Nb | 2150 | 0.6 | 13.9 | 2.6 | 1.5 | 0.01 | 2.5 | 0.006 | bal. |
| 11V-0Nb | | 0.6 | 13.1 | 2.5 | 1.8 | — | 2.4 | 0.004 | bal. |

TABLE 3

Chemical composition of MC primary carbides at 2050° F. and 2150° F. calculated with Thermo-Calc coupled with TCFE3 database.

| | | Chemical Composition of MC Primary Carbides [at. %] | | | | | | | |
|---|---|---|---|---|---|---|---|---|---|
| Alloy | [° F.] | C | Cr | Mo | V | Nb | Co | N | Fe |
| 9V-3.5Nb | 2050 | 43.2 | 5.1 | 3.6 | 36.4 | 9.1 | 0.003 | 2.2 | 0.4 |
| 11V-0Nb | | 41.9 | 7.4 | 3.8 | 43.8 | — | 0.003 | 2.2 | 0.8 |
| 9V-3.5Nb | 2150 | 43.1 | 5.9 | 3.3 | 35.9 | 9.1 | 0.004 | 2.2 | 0.5 |
| 11V-0Nb | | 41.8 | 8.4 | 3.5 | 43.1 | — | 0.005 | 2.1 | 1.0 |

TABLE 4

Chemical compositions of the corrosion and wear resistant martensitic tool steels tested.

| Alloy | Chemical Composition of Alloy [wt. %] | | | | | | | |
|---|---|---|---|---|---|---|---|---|
| | C | Cr | Mo | V | W | Nb | Co | N |
| A | 2.31 | 13.94 | 1.04 | 8.73 | — | — | — | 0.07 |
| B | 1.12 | 16.12 | 0.06 | — | — | — | — | 0.06 |
| C | 1.72 | 18.19 | 0.95 | 3.16 | | | | 0.111 |
| D | 1.9 | 19.68 | 0.95 | 4.48 | 0.6 | | | 0.23 |
| E | 2.3 | 20 | 1 | 4.2 | — | 1.9 | — | 0.07 |

TABLE 5

EDS semi-quantitative chemical compositions of the primary carbides in the alloy of the invention (04-099) and Alloy A (only metallic elements). Both alloys were hardened from 2150° F. in oil and tempered at 975° F. for 2 h + 2 h + 2 h.

| Alloy | Carbide | Carbide Type | EDS semi-quantitative chemical analysis [wt. %] | | | | |
|---|---|---|---|---|---|---|---|
| | | | Cr | Mo | V | Nb | Fe |
| 04-099 | A | NbC | 3.7 | — | 12.1 | 71.3 | 12.9 |
| 04-099 | B | NbC | 3.3 | — | 12.4 | 74.4 | 9.9 |
| 04-099 | E | (V,Nb)C | 7.6 | — | 33.5 | 39.0 | 19.9 |
| 04-099 | F | (V,Nb)C | 5.6 | — | 46.3 | 45.6 | 2.5 |
| 04-099 | G | (V,Nb)C | 6.5 | 12.4 | 48.3 | 27.9 | 4.9 |
| 04-099 | H | (V,Nb)C | 5.8 | — | 44.3 | 46.3 | 3.6 |
| 04-099 | J | (V,Nb)C | 6.0 | 9.3 | 44.2 | 38.0 | 2.5 |
| A | D | VC | 8.2 | 1.8 | 86.4 | — | 3.6 |
| A | E | VC | 8.6 | 1.5 | 87.5 | — | 2.4 |
| A | F | VC | 9.2 | 5.4 | 82.4 | — | 3.0 |

TABLE 6

Calculated matrix chemical compositions of corrosion and wear resistant tool steels.

| Alloy | [° F.] | Chemical Composition of Austenitic Matrix [wt. %] | | | | | | | | |
|---|---|---|---|---|---|---|---|---|---|---|
| | | C | Cr | Mo | V | W | Nb | Co | N | PRE |
| A | 2100 | 0.5 | 12.3 | 0.8 | 1.7 | — | — | — | 0.002 | 14.8 |
| B | 1900 | 0.4 | 11.6 | 0.1 | — | — | — | — | 0.07 | 12.9 |
| C | 2100 | 0.6 | 12.7 | 0.9 | 1.2 | — | — | — | 0.02 | 16.0 |
| D | 2100 | 0.5 | 13.8 | 0.9 | 1.3 | 0.6 | — | — | 0.03 | 18.2 |
| E | 2100 | 0.5 | 14.0 | 0.9 | 1.2 | — | 0.01 | — | 0.01 | 17.1 |
| 04-099 | 2100 | 0.5 | 13.7 | 2.5 | 1.3 | — | 0.01 | 2.5 | 0.01 | 22.1 |

TABLE 7

Pitting potentials ($E_{pit}$) in 1% NaCl aqueous solution.

| Alloy | PRE | $E_{pit}$ [mV] vs. SCE | | | |
|---|---|---|---|---|---|
| | | 500° F. | 750° F. | 975° F. | 1025° F. |
| A | 14.8 | 59 | −17 | −176 | −183 |
| B | 12.9 | −140 | −249 | −355 | −321 |
| C | 16.0 | 213 | 243 | −211 | −216 |
| D | 18.2 | 160 | −121 | −170 | −179 |
| E | 17.1 | 97 | 138 | −164 | −282 |
| 04-099 | 22.1 | 403 | 272 | −17 | −71 |

TABLE 8

Corrosion rates for the alloys tested in an aqueous solution of 2.5% $HNO_3$ + 0.5% HCl.

| Alloy | % Cr in the matrix | Corrosion Rate (mm/yr) | | | |
|---|---|---|---|---|---|
| | | 500° F. | 750° F. | 975° F. | 1025° F. |
| A | 12.3 | 7.5 | 9.3 | 45.7 | 31.4 |
| B | 11.6 | 43.0 | 43.9 | 77.0 | 72.2 |
| C | 12.7 | 3.5 | 9.2 | 75.3 | 89.8 |
| D | 13.8 | 2.1 | 6.6 | 40.7 | 53.7 |
| E | 14.0 | 5.4 | 16.6 | 56.6 | 46.7 |
| 04-099 | 13.7 | 0.1 | 0.4 | 9.0 | 6.1 |

TABLE 9

Heat treatment response of alloys hardened from 2150° F. in oil and tempered for 2 h + 2 h + 2 h.

| Bar No. | Tempering Temperature [° F.] | | | | | | | |
|---|---|---|---|---|---|---|---|---|
| | 500 | 750 | 975 | 1000 | 1025 | 1050 | 1100 | 1200 |
| 04-098 | 59.5 | 59.5 | 62.5 | 60.5 | 59.5 | 58.5 | 53.0 | 46.5 |
| 04-099 | 60.0 | 60.5 | 63.5 | 61.5 | 60.5 | 58.5 | 53.5 | 47.5 |
| Alloy A | 58.5 | 60.5 | 61.5 | 60.5 | | | | |

TABLE 10

Pin-abrasion wear resistance of alloys (hardened from 2150° F.).

| Bar Number | Temper [° F.] | HRC | Pin Abrasion [mg] |
|---|---|---|---|
| 04-098 | 500 | 59.5 | 49.5 |
| | 975 | 62.5 | 33.7 |
| 04-099 | 500 | 60.0 | 45.4 |
| | 975 | 63.5 | 29.4 |
| Alloy A | 500 | 58.5 | 52.0 |
| | 975 | 61.5 | 37.3 |

What is claimed:

1. A corrosion and wear resistant tool steel article produced by hot isostatic compaction of nitrogen gas atomized prealloyed powder particles consisting essentially of, in weight percent:

C: 2.0-3.5;
Si: 1.0 max.;
Mn: 1.0 max.;
Cr: 12.5-18.0;
Mo: 2.0-5.0;
V: 6.0-11.0;
Nb: 2.0-6.0;
Co: 1.5-5.0;
N: 0.11-0.30;

and the balance is essentially iron and incidental impurities.

2. A corrosion and wear resistant tool steel article produced by hot isostatic compaction of nitrogen gas atomized prealloyed powder particles consisting essentially of, in weight percent:

C: 2.3-3.2;
Si: 0.9 max.;
Mn: 0.8 max.;
Cr: 13.0-16.5;
Mo: 2.5-4.5;
V: 7.0-10.5;
Nb: 2.8-5.0;

Co: 1.5-4.0;
N: 0.11-0.25;
and the balance is essentially iron and incidental impurities.

3. A corrosion and wear resistant tool steel article produced by hot isostatic compaction of nitrogen gas atomized prealloyed powder particles consisting essentially of, in weight percent:

C: 2.7-3.0;
Si: 0.70 max.;
Mn: 0.50 max.;
Cr: 13.5-14.5;
Mo: 3.0-4.0;
V: 8.5-9.5;
Nb: 3.0-4.0;
Co: 2.0-3.0;
N: 0.11-0.20;
and the balance is essentially iron and incidental impurities.

4. The alloy of claim 1, claim 2, or claim 3, wherein carbon is balanced with chromium, molybdenum, niobium, vanadium, and nitrogen in accordance with:

$$C_{min}=0.4+0.099\times(\%\ Cr-11)+0.063\times\%\ Mo+0.177\times\%\ V+0.13\times\%\ Nb-0.85\times\%\ N$$

$$C_{max}=0.6+0.099\times(\%\ Cr-11)+0.063\times\%\ Mo+0.177\times\%\ V+0.13\times\%\ Nb-0.85\times\%\ N.$$

5. A corrosion and wear resistant tool steel alloy produced by hot isostatic compaction of nitrogen gas atomized prealloyed powder particles according to claim 1, claim 2, or claim 3, in which the microstructure contains at least 20% of primary carbides of which at least 50% are MC type carbides.

$$Cmin=0.4+0.099\times(\%\ Cr-11)+0.063\times\%\ Mo+0.177\times\%\ V+0.13\times\%\ Nb-0.85\times\%\ N.$$

6. The alloy of claim 5, in which at least 5% of the MC carbides are Nb-rich, the remaining MC carbides being Nb-V-rich or V-rich.

7. The alloy of claim 1, claim 2, or claim 3 of which corrosion pitting potential measured in 1% NaCl aqueous solution is at least 250 mV after tempering at a lower tempering temperature of 500° F.-750° F., and greater than −100 mV after tempering at a higher tempering temperature, i.e., 975° F.-1025° F.

* * * * *

UNITED STATES PATENT AND TRADEMARK OFFICE

CERTIFICATE OF CORRECTION

PATENT NO. : 7,288,157 B2 
APPLICATION NO. : 11/598082
DATED : October 30, 2007
INVENTOR(S) : Alojz Kajinic et al.

It is certified that error appears in the above-identified patent and that said Letters Patent is hereby corrected as shown below:

On the Title Page, replace the Figure:

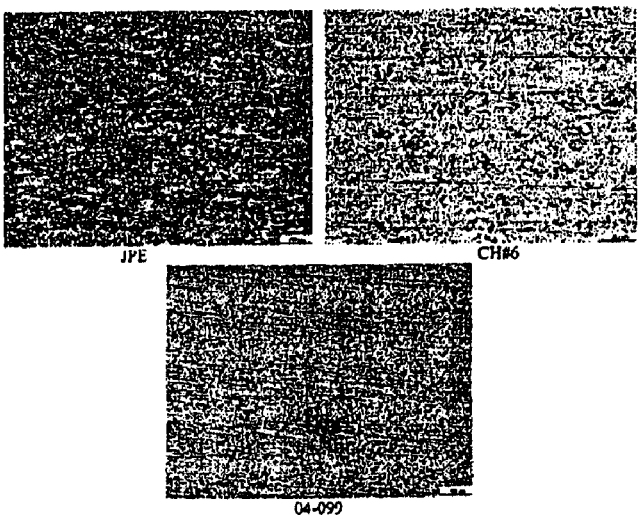

with Figure 1 on page 2 of this Certificate of Correction:

UNITED STATES PATENT AND TRADEMARK OFFICE

CERTIFICATE OF CORRECTION

PATENT NO. : 7,288,157 B2
APPLICATION NO. : 11/598082
DATED : October 30, 2007
INVENTOR(S) : Alojz Kajinic et al.

It is certified that error appears in the above-identified patent and that said Letters Patent is hereby corrected as shown below:

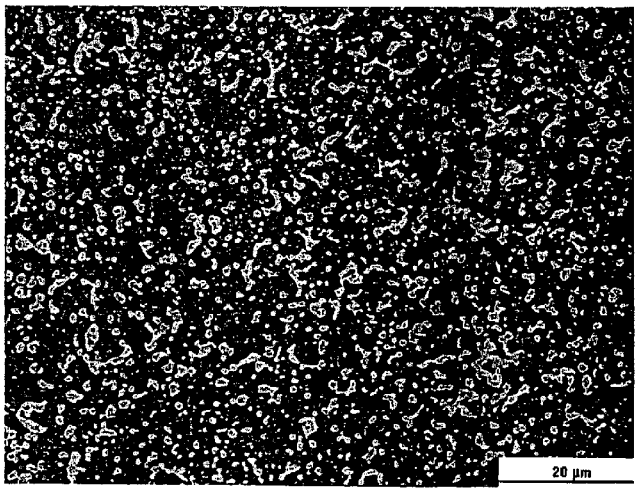

Figure 1: Microstructure (magnification of 500X) of the alloy of the invention (04-099) hardened from 2150°F in oil and tempered at 975°F for 2h+2h+2h. Etched with Vilella's reagent for 90 seconds. The total volume of primary carbides is approximately 21.7 %.

In the drawings, Sheet 1 of 4, Please replace Figure 1:

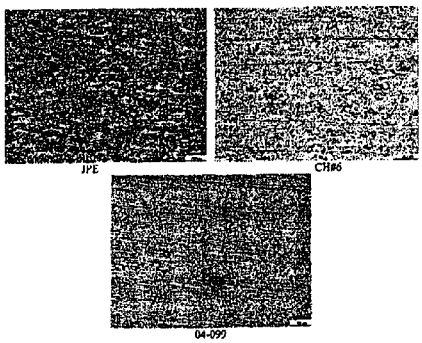

with Figure 1 on page 3 of this Certificate of Correction:

UNITED STATES PATENT AND TRADEMARK OFFICE

CERTIFICATE OF CORRECTION

PATENT NO. : 7,288,157 B2
APPLICATION NO. : 11/598082
DATED : October 30, 2007
INVENTOR(S) : Alojz Kajinic et al.

It is certified that error appears in the above-identified patent and that said Letters Patent is hereby corrected as shown below:

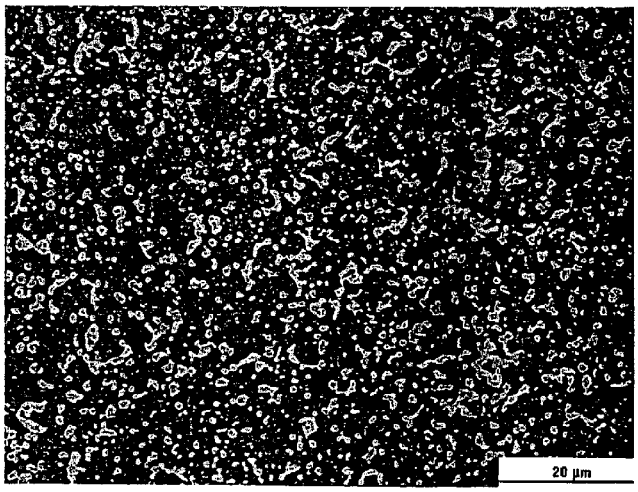

Figure 1: Microstructure (magnification of 500X) of the alloy of the invention (04-099) hardened from 2150°F in oil and tempered at 975°F for 2h+2h+2h. Etched with Vilella's reagent for 90 seconds. The total volume of primary carbides is approximately 21.7 %.

UNITED STATES PATENT AND TRADEMARK OFFICE

CERTIFICATE OF CORRECTION

PATENT NO. : 7,288,157 B2
APPLICATION NO. : 11/598082
DATED : October 30, 2007
INVENTOR(S) : Alojz Kajinic et al.

It is certified that error appears in the above-identified patent and that said Letters Patent is hereby corrected as shown below:

Column 5, line 57, "1.54.0%" should be replaced with --1.5-4.0%--

Claim 5, line 7, delete "$C_{min} = 0.4 + 0.099\times(\%Cr - 11) + 0.063\times\%Mo + 0.177\times\%V + 0.13\times\%Nb - 0.85\times\%N$"

Signed and Sealed this

Eighth Day of April, 2008

JON W. DUDAS
*Director of the United States Patent and Trademark Office*